US006680576B2

(12) United States Patent
Jeon

(10) Patent No.: US 6,680,576 B2
(45) Date of Patent: Jan. 20, 2004

(54) LIGHTING APPARATUS USING MICROWAVE

(75) Inventor: Yong Seog Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/059,317

(22) Filed: Jan. 31, 2002

(65) Prior Publication Data

US 2002/0105276 A1 Aug. 8, 2002

(30) Foreign Application Priority Data

Feb. 2, 2001 (KR) ..... 2001/5113

(51) Int. Cl.[7] ..... H05B 41/24
(52) U.S. Cl. ..... 315/112; 315/248; 315/39.51
(58) Field of Search ..... 315/248, 112–118, 315/344, 39, 39.51; 313/231.31, 35; 362/351, 373

(56) References Cited

U.S. PATENT DOCUMENTS 4,498,029 A * 2/1985 Yoshizawa et al. ..... 315/39
5,998,934 A * 12/1999 Mimasu et al. ..... 315/118
6,049,170 A * 4/2000 Hochi et al. ..... 315/39
6,509,697 B2 * 1/2003 Ervin et al. ..... 315/248

* cited by examiner

*Primary Examiner*—Wilson Lee
(74) *Attorney, Agent, or Firm*—Birch, Stewart, Kolasch & Birch, LLP

(57) ABSTRACT

A lighting apparatus which uses microwave energy which includes a microwave generator disposed inside a casing for generating microwave energy, a waveguide for transmitting the microwave energy, a resonator for covering an outlet of the waveguide, a bulb placed inside a resonator for generating light by the microwave energy transmitted through the waveguide, a conduction block in contact with the microwave generator for receiving heat generated in the microwave generating process, a heat transfer unit connected between the conduction block and the casing for transmitting heat from the conduction block to the casing and a radiating unit installed at the end of the heat transfer unit for radiating heat transmitted from the conduction block to the casing or outside of the casing.

28 Claims, 14 Drawing Sheets

LIGHTING APPARATUS USING MICROWAVE

BACKGROUND OF THE INVENTION

1. Field of the Invention

The present invention relates to a lighting apparatus using microwave energy, and more particularly, to a lighting apparatus using microwave energy which is capable of radiating heat generated in a microwave generator outside of a casing.

2. Description of the Background Art

A lighting apparatus using microwaves emits visible rays or ultraviolet rays by applying microwaves to an electrodeless lamp. Such a device has a longer lifespan and provides better lighting efficiency than that of an incandescent lamp or a fluorescent lamp.

FIG. 1 is a longitudinal, sectional view illustrating a lighting apparatus using microwaves in accordance with the background art.

The lighting apparatus using microwaves is constructed with a front casting 1, a rear casing 2, a waveguide 3 for transmitting microwaves generated in a magnetron 10, and a high voltage generator 4 for boosting the AC power and supplying it to the magnetron 10.

A reflecting mirror 6 for reflecting light generated in a bulb 5 towards the front is installed at the exterior of the front casing 1.

The magnetron 10 generating microwaves is installed at the side wall of the waveguide 3. The bulb 5 generating light with enclosed materials in a plasma state by microwave is installed at the upper portion of the waveguide 3. A resonator 8 for passing the light emitted in the bulb 5 while cutting off the microwaves covers the front side of the bulb 5 and is assembled so as to project from the front casing 1.

A bulb motor 7 is connected to the bulb 5 with a shaft 5*a* and rotates the bulb 5 in order to cool it down.

A fan housing 9*a* having a suction hole 2*a* and a discharge hole 2*b* is placed in the rear casing 2 in order to cool down the magnetron 10 and the high voltage generator 4, etc.

A cooling fan 9*b* is installed inside the fan housing 9*a*, and a fan motor 9*c* which operates the cooling fan 9*b* is installed inside the rear casing 2.

An outlet 1*a* is formed at the front casing 1 in order to discharge the air drawn in by the operation of the cooling fan 9*b* after cooling down the elements inside the casing.

FIG. 2 is a sectional view taken along the line of A—A of FIG. 1. It illustrates the structure of the magnetron of the lighting apparatus using microwave in accordance with the background art.

The magnetron 10 includes a housing 19 containing the elements for generating microwaves and a filter box 20 connected to the high voltage generator 4, shown in FIG. 1 for applying the boosted voltage and having a condenser 21 and a choke coil 23 for performing a filter function. An output pipe 25 extends inside of the waveguide 3, as shown at FIG. 1 for outputting microwave is placed at the front of the housing 19.

Inside the housing 19, there is a cathode unit 15 having a filament shape which emits a large amount of heat electrons by being heated with power applied through the filter box 20; an anode unit 11 generating microwaves by moving the electrons from the cathode unit 15 between a vane 13 and a strap 14 at a requested frequency bandwidth according to certain rules when a fixed amount of anode voltage and anode currents are applied to an anode body 12 having a cylinder shape; an antenna 16 for transmitting the microwave energy generated in the operation space of the anode unit 11 and the cathode unit 15 inside the waveguide 1 as shown at FIG. 1; and permanent magnets 17*a*, 17*b* respectively installed at the upper portion and the lower portion of the anode body 12 of the anode unit 11 and forming a lock down circuit.

Inside the housing 19 a cooling pin 18 is installed at the circumference of the anode body 12 of the anode unit 11. It has a wave structure and forms an air-cooling structure inside the housing 19 by being assembled in a plurality of layers uniformly arranged at the circumference of the anode body 12.

The operation of the lighting apparatus using microwave energy in accordance with the background art will now be described.

As depicted in FIG. 1, when an operational signal is inputted to the high voltage generator 4, the high voltage generator 4 boosts the AC power and supplies it to the magnetron 10.

The magnetron 10 generates microwave energy having a very high frequency by being oscillated by the high voltage supplied from the high voltage generator 4. The generated microwave energy is emitted inside the resonator 8 through the waveguide 3, excites the materials enclosed in the bulb 5 and generates light having an inherent emitting spectrum.

The light generated in the bulb 5 collectively reflects toward the front through the reflecting mirror 6 and lightens the adjacent space.

In the process of generating the lumination by microwave energy, heat having a high temperature is generated at the inner side of the anode unit 11 of the magnetron 10, and this heat is transmitted to the housing 19 through the cooling pins 18. Also, part of the heat is radiated inside the casings 1, 2.

The cooling fan 9*b* is rotated by the motor 9*c* and air which is drawn in from the outside through the suction hole 2*a* of the rear casing 2 cools the magnetron 10 and the casings 1, 2. The air which cools the magnetron 10 is discharged to outside through the outlet 1*a* of the front casing 1.

However, in the lighting apparatus using microwave energy in accordance with the background art, because the fan motor 9*c* and the cooling fan 9*b* installed in order to cool down the magnetron 10 are noisy, it is undesirable to use such a device in spaces which require calm and quiet lighting such, as an office and in the home, etc.

In addition, when the lighting apparatus using microwave energy in accordance with the background art is installed at outside, impurities such as bugs and dust can be drawn into the casings 1, 2 through the suction hole 2*a* and the outlet 1*a*, covering the internal parts of the apparatus with dust and the dead bodies of bugs. In such cases, the impurities may affect the electric circuits or operational elements of the system causing mechanical problems.

In addition, in lighting apparatus using microwave energy, in accordance with the background art, because the cooling pins 18 are placed inside the magnetron 10 and the fan housing 9*a*, the cooling fan 9*b* and the fan motor 9*c* are installed at the rear of the casings 1, 2, making the structure of the lighting system intricate, and increasing the volume or size of the lighting system such that it occupies much space.

SUMMARY OF THE INVENTION

In order to solve the above-mentioned problems, it is an object of the present invention to provide a lighting system using microwave energy which is capable of being used in circumstances requiring a low noise, by reducing the occurrence of noise caused by the fan and fan motor by irradiating the heat generated in the magnetrons by providing a heat pipe having good heat conductivity between the magnetron and a casing, etc. without using the fan and the fan motor.

In addition, it is another object of the present invention to provide a lighting apparatus using microwave energy which is capable of improving the reliability of a lighting system by sealing a casing hermetically so as to prevent penetration of impurities such as bugs and dust by constructing a lighting apparatus so as to radiate heat outside of the casing by a heat transfer method.

In order to achieve the above-mentioned objects, a lighting system using microwave energy in accordance with the present invention includes a microwave generator installed inside a casing and generating microwave energy, a waveguide for transmitting the microwave energy oscillated by the microwave generator, a resonator for covering the outlet of the waveguide, cutting off any leakage of the microwaves and passing light, a bulb placed inside the resonator for generating light by the microwave energy transmitted through the waveguide, a conduction block closely adhered to the microwave generator, to which heat generated in the microwave generating process is transmitted, a heat transfer means connected between the conduction block and the casing for transmitting heat from the conduction block to the casing, and a radiating means installed at the end of the heat transfer means for radiating heat transmitted from the conduction block outside of the casing.

In addition, in order to achieve the above-mentioned objects, a lighting apparatus using microwave energy in accordance with the present invention includes a microwave generator installed inside a casing and generating microwave energy, a waveguide for transmitting the microwave energy oscillated by the microwave generator, a resonator for covering the outlet of the waveguide, cutting off leakage of the microwave energy and passing light, a bulb placed inside the resonator and generating light by the microwave energy transmitted through the waveguide, a conduction block adhered closely to the microwave generator, to which the heat generated in the microwave generating process is transmitted, a heat pipe installed between the conduction block and the exterior of the casing in order to transmit the heat by using latent heat of a working fluid, and a radiating means installed at the end of the heat pipe for radiating the heat transmitted through the heat pipe to the outside of the casing.

In addition, in order to achieve the above-mentioned objects, a lighting system using microwave energy in accordance with the present invention includes a microwave generator installed inside a casing for generating microwave energy, a waveguide for transmitting the microwave energy oscillated by the microwave generator, a resonator for covering the outlet of the waveguide and eliminating the leakage of microwave energy and passing light, a bulb placed inside the resonator for generating light by the microwave energy transmitted through the waveguide, a conduction block adhered closely to the microwave generator, to which the heat generated in the microwave generating process is transmitted, a heat pipe installed between the conduction block and the interior of the casing for transferring the heat by using the latent heat of a working fluid, and a metal member having high heat conductivity for radiating heat transmitted through the heat pipe.

In addition, in order to achieve the above-mentioned objects, a lighting system using microwave energy in accordance with the present invention includes a microwave generator installed inside a casing for generating microwave energy, a waveguide for transmitting the microwave energy oscillated by the microwave generator, a resonator for covering the outlet of the waveguide, and eliminating the leakage of the microwave energy and passing light, a bulb placed inside the resonator for generating light by the microwave transmitted through the waveguide, a conduction block adhered closely to the microwave generator, to which the heat generated in the microwave generating process is transmitted, a heat conduction rod installed at the conduction block and the inner surface of the casing in order to transmit heat from the conduction block to the inner surface of the casing, and a metal member having a high heat conductivity for radiating heat transmitted through the heat pipe.

In addition, in order to achieve the above-mentioned objects, a lighting system using microwave energy in accordance with the present invention includes a microwave generator installed inside a casing for generating microwave energy, a waveguide for transmitting the microwave energy oscillated by the microwave generator, a resonator for covering the outlet of the waveguide, and eliminating the leakage of the microwave energy and passing light, a bulb placed inside the resonator for generating light by the microwave energy transmitted through the waveguide, a conduction block adhered closely to the microwave generator for receiving the heat generated in the microwave generating process, said conduction block being connected to the inner surface of the casing in order to transmit the heat to the inner surface of the casing, and a casing constructed with a metal member, at least one part of which having a high conductivity in order to radiate heat transmitted through the conduction block to the outside.

The lighting system using microwave energy in accordance with the present invention can prevent the occurrence of noise while in use by not using a cooling fan and a fan motor, etc. and accordingly, can be used in quiet environments, such as an office, home, etc.

In addition, the lighting apparatus using microwave energy in accordance with the present invention reduces mechanical troubles caused by uncleanness and impurities, by hermetically sealing the casing which reliability improves the lighting system.

In addition, the lighting system using microwave energy in accordance with the present invention provides a simpler and smaller structure and accordingly can be installed in a small space.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Hereinafter, a lighting system using microwave energy in accordance with the preferred embodiments of the present invention will be described with reference to the following figures.

Figure 1:
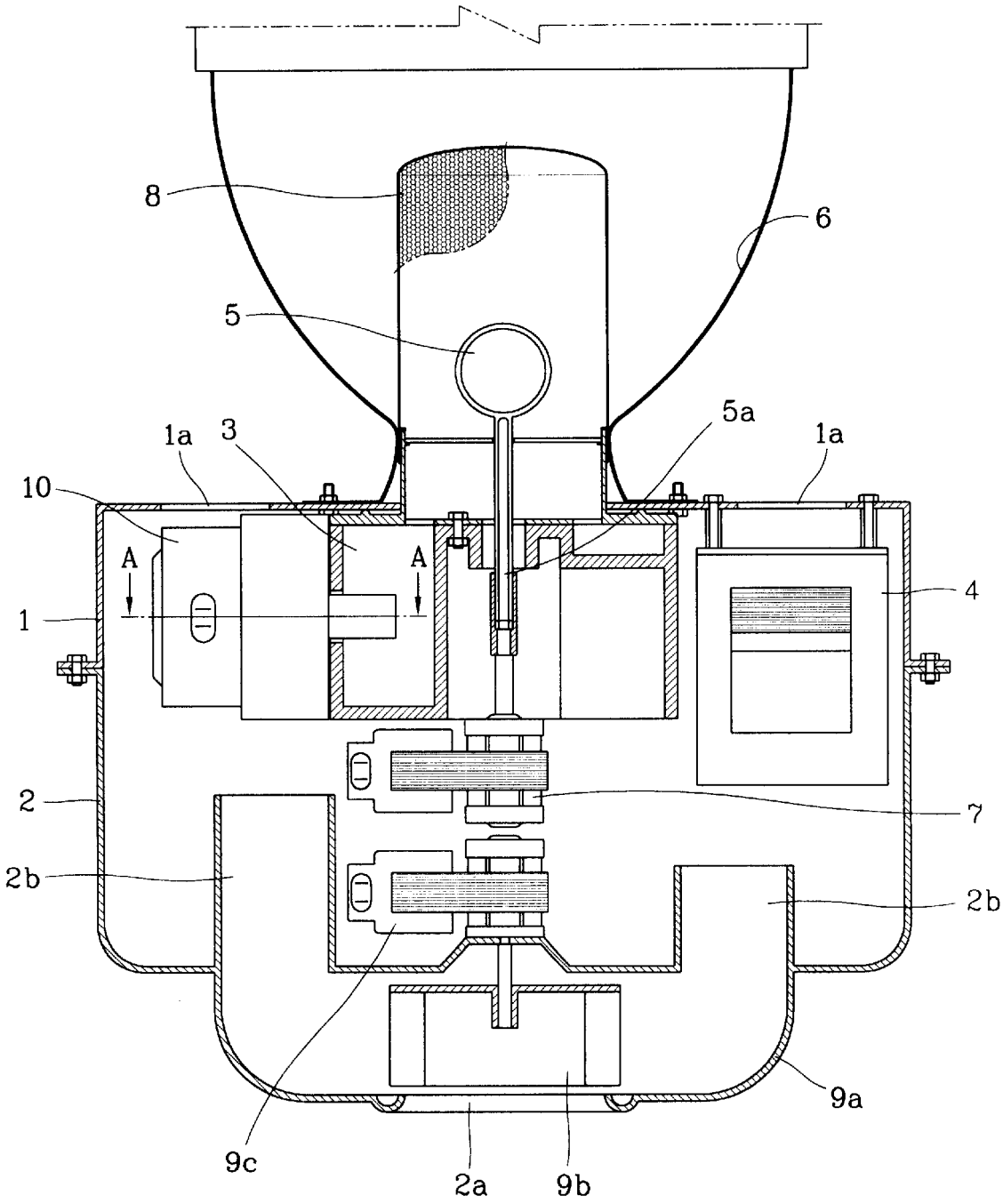
FIG. 1 BACKGROUND ART
FIG. 1 is a longitudinal, sectional view illustrating a lighting system using microwave energy in accordance with the background art.
Figure 2:
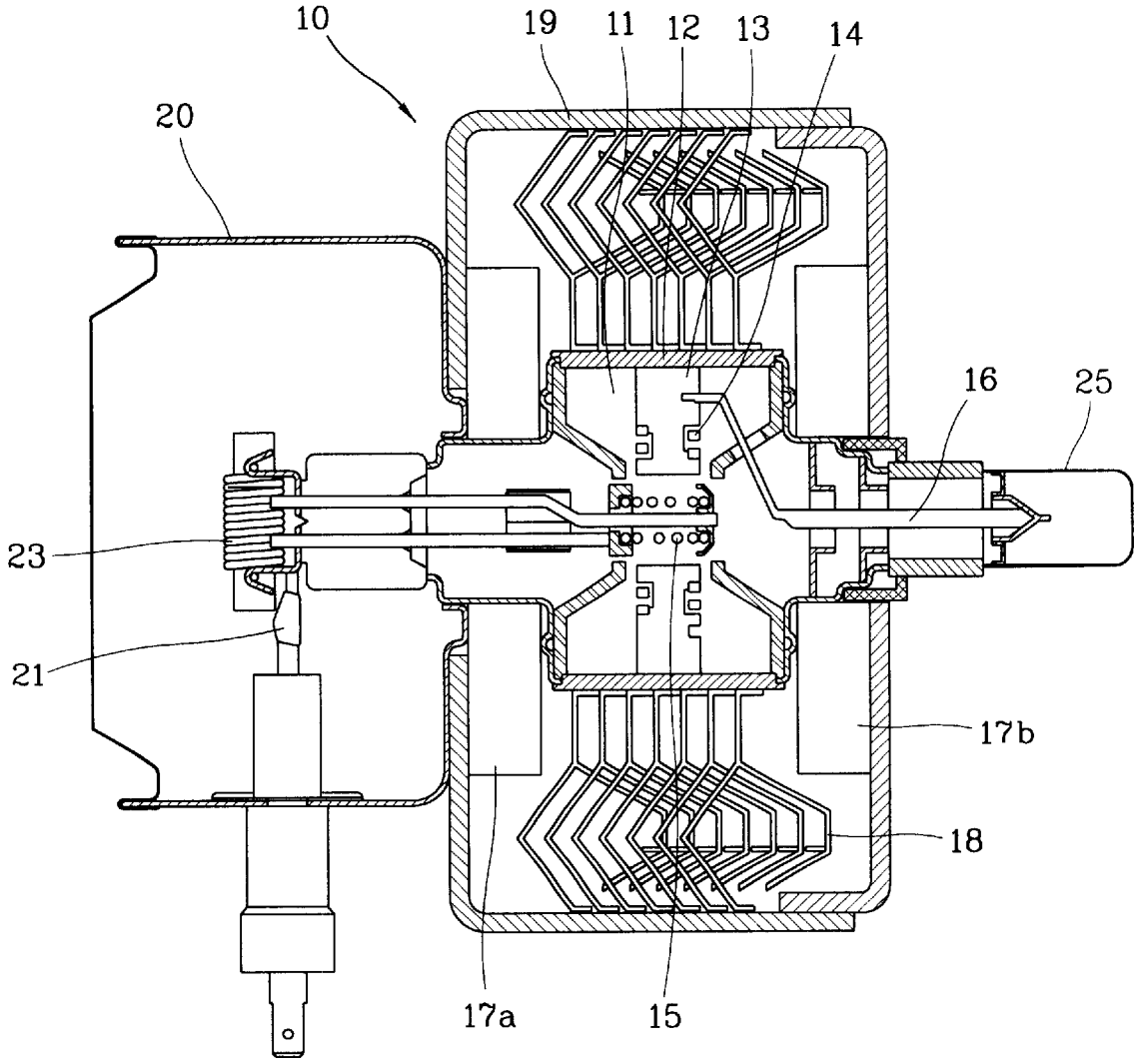
FIG. 2 BACKGROUND ART
FIG. 2 is a sectional view taken along the line A—A of FIG. 1 and illustrating the internal structure of a magnetron.
Figure 3:
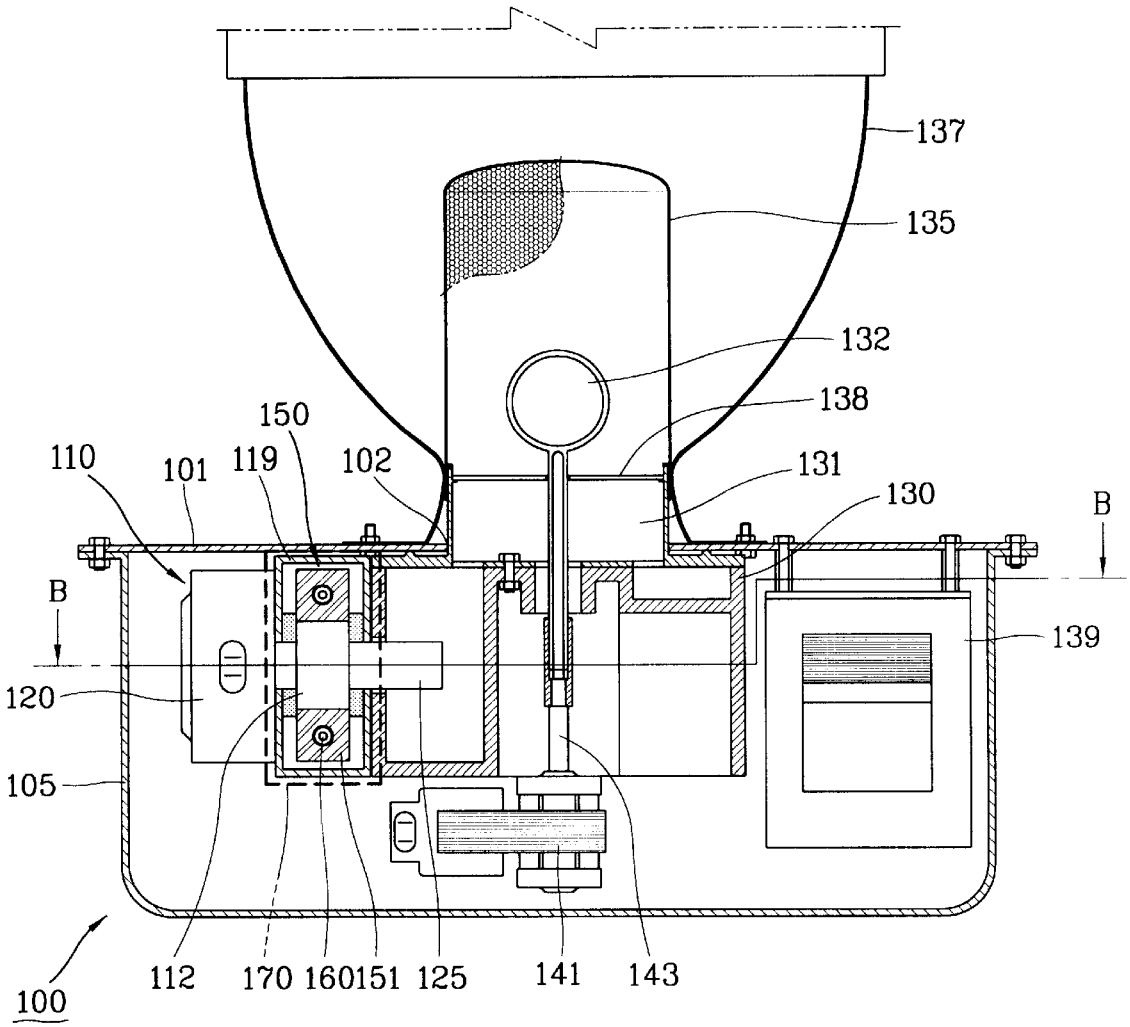
FIG. 3 is a longitudinal, sectional view illustrating the lighting system using microwave energy in accordance with a first embodiment of the present invention.
Figure 4:
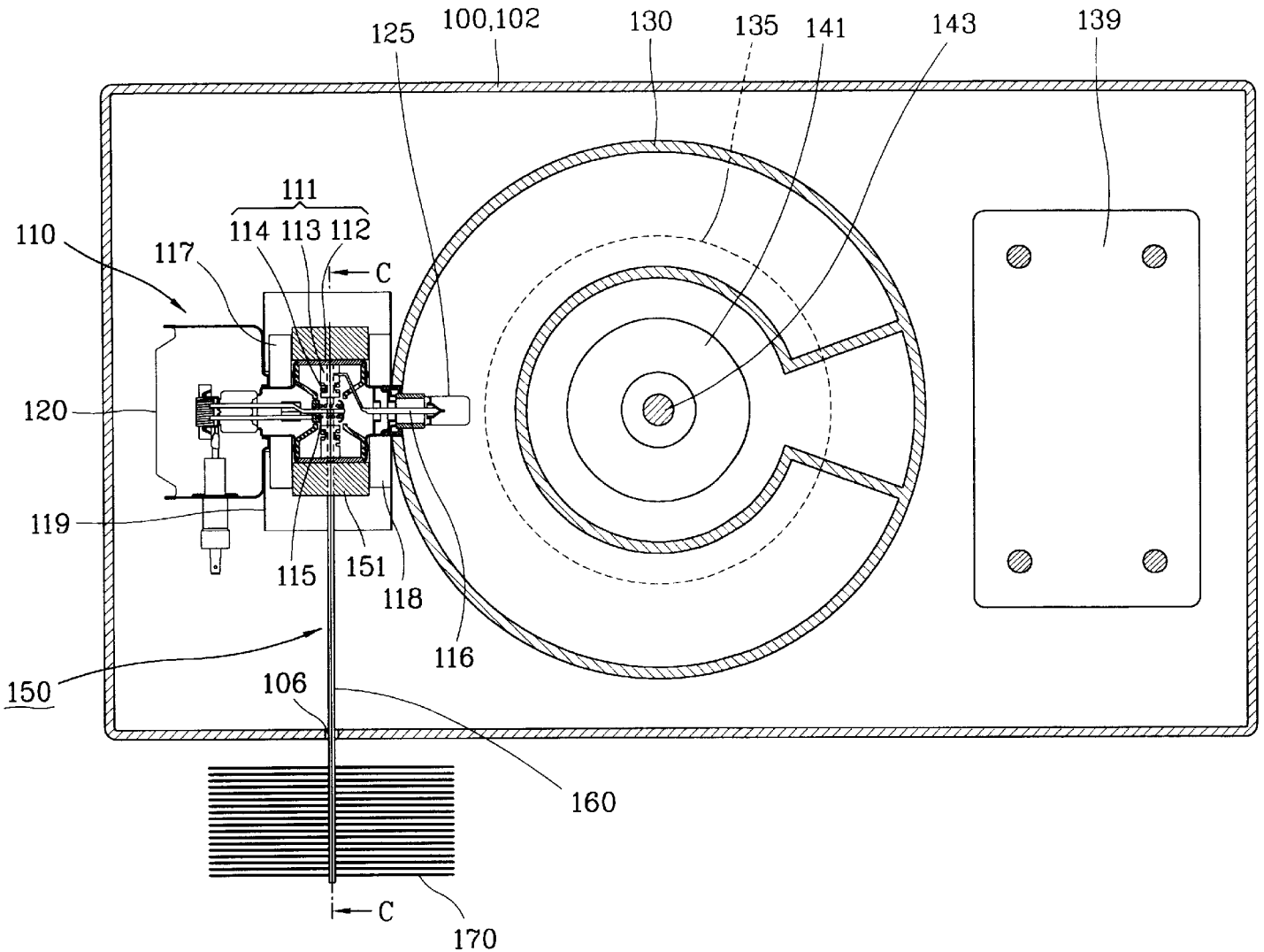
FIG. 4 is a sectional view taken along line B—B of FIG. 3.
Figure 5:
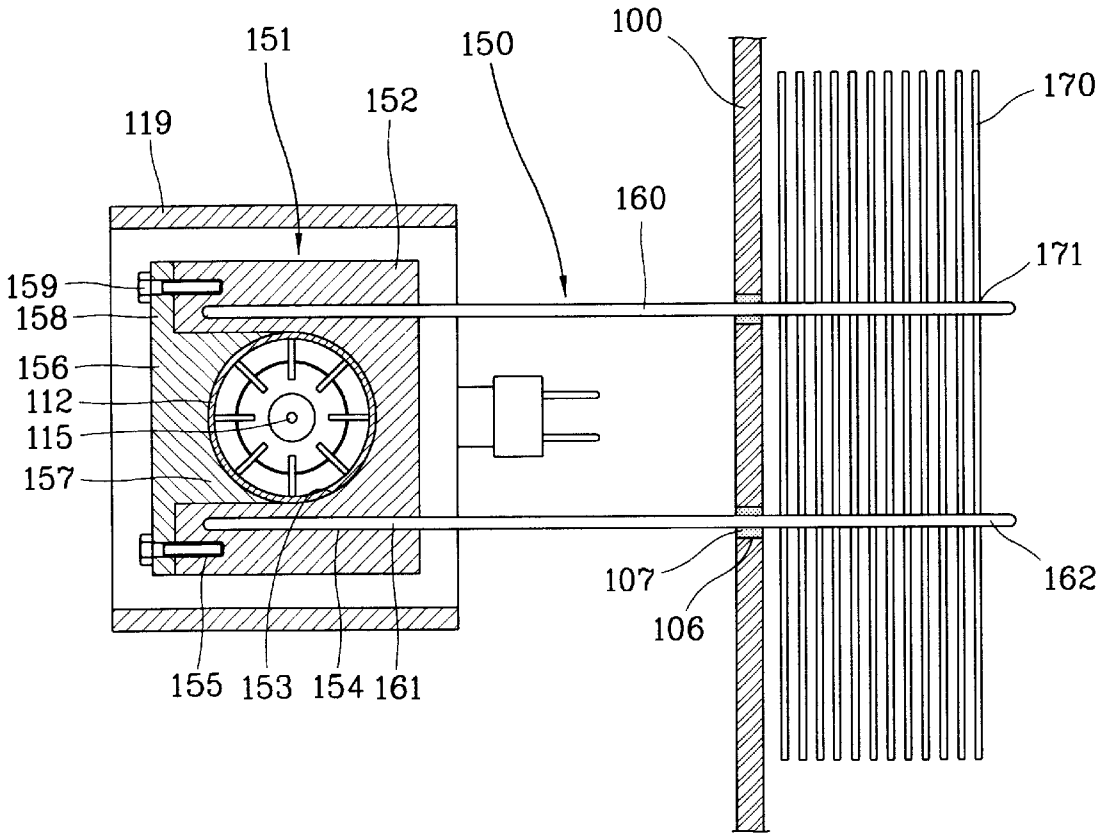
FIG. 5 is a sectional view taken along line C—C of FIG. 4.
Figure 6:
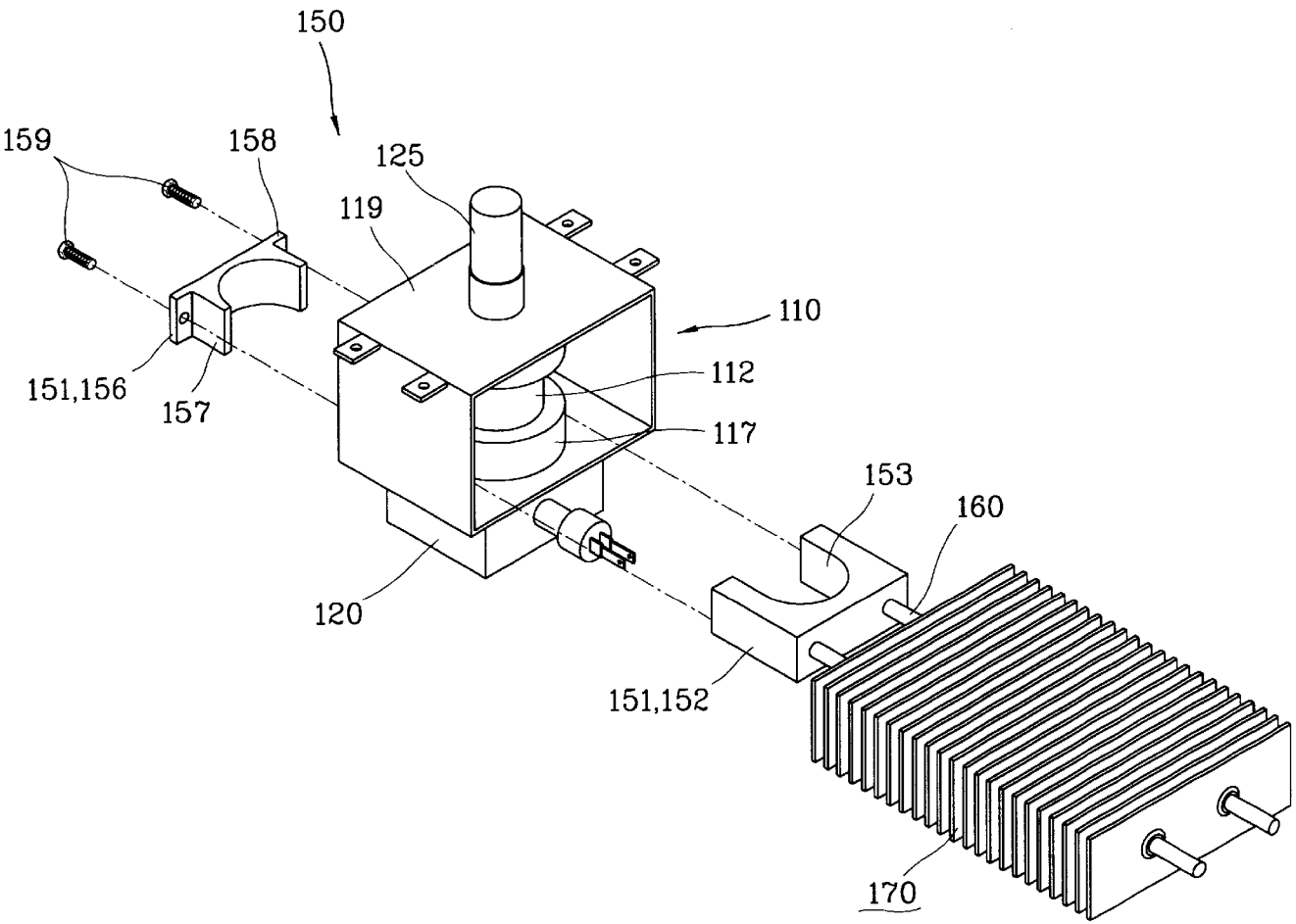
FIG. 6 is a disassembled perspective view illustrating the magnetron cooling apparatus in accordance with the first embodiment of the present invention.
Figure 7:
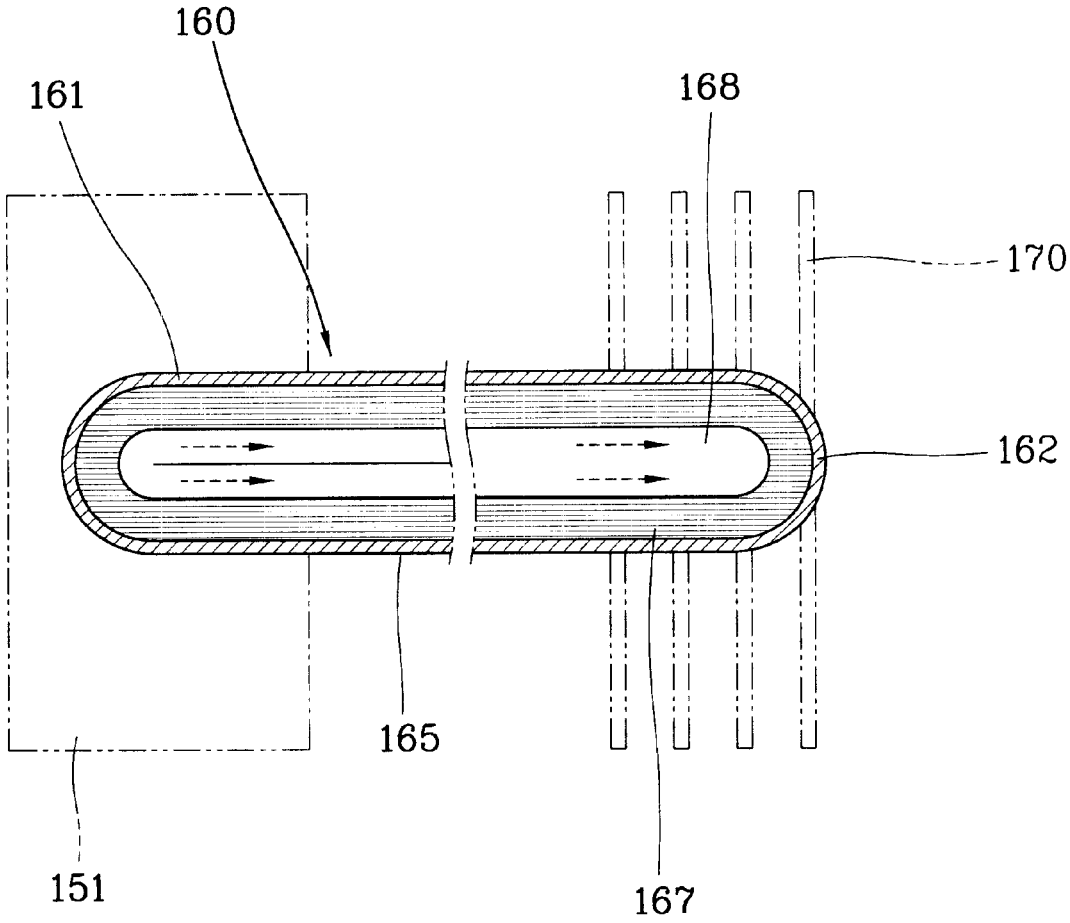
FIG. 7 is a sectional view illustrating a heat pipe used in the first embodiment of the present invention.

FIGS. 3 to 7 illustrate a lighting apparatus using microwave energy in accordance with a first embodiment of the present invention, in which FIG. 3 is a longitudinal sectional view illustrating a lighting system using microwave energy in accordance with the first embodiment of the present invention; FIG. 4 is a sectional view taken along line B—B of FIG. 3; FIG. 5 is a sectional view taken along line C—C of FIG. 4; FIG. 6 is a disassembled perspective view illustrating a magnetron cooling apparatus in accordance with the first embodiment of the present invention; and FIG. 7 is a sectional view illustrating a heat pipe used in the first embodiment of the present invention.

The lighting apparatus using microwave energy in accordance with the present invention will be described with reference to FIGS. 3 and 4. A magnetron 110, a waveguide 130, a bulb 132, and a resonator 135 are installed in a casing assembly 100 assembled with a front casing 101, a rear casing 105, and a reflecting mirror 137 installed in front of the front casing 101 for reflecting light radiating from the bulb 132 toward front.

A hole 102 is formed at the center of the front casing 101 in which the reflecting mirror 137, and a cylinder-shaped waveguide 130 is assembled for transmitting microwave energy from the magnetron 110 into the resonator 135.

The magnetron 110 for generating microwave energy is installed on the side surface of the waveguide 130.

A high voltage generator 139 for boosting the utility AC power and supplying it to the magnetron 110 is installed at the opposite side of the magnetron 110 centering around the waveguide 130 and is assembled into the front casing 101.

At the inside of the reflecting mirror 137 placed in front of the front casing 101, the resonator 135 is provided for covering the end 131 of the waveguide 130 in order to cut off microwave energy and pass light emitted from the bulb 132. The bulb 132 is placed inside the resonator 135 in order to generate light with enclosed materials being transitioned to a plasma state by the microwave energy transmitted through the waveguide 130.

The bulb 132 is connected to a bulb motor 141 by a shaft 143, at the inner surface of the casing assembly 100, assembled into the lower portion of the waveguide 130. Accordingly the position of the bulb 132 is supported by the shaft 143, the heat generated and emitted by being rotated by the bulb motor 141 is cooled down and the plasma generated in the bulb 132 can be regularly mixed.

The reflecting mirror 138 is installed in the outlet 131 of the waveguide 130 in order to reflect the light generated from the bulb 132 and pass the microwave energy transmitted through the waveguide 130.

As depicted in FIG. 4, the magnetron 110 includes a housing 119 having each construction part generating microwave energy, and both side surfaces of the housing 119 are open.

A filter box 120 connected to the high voltage generator 139 is placed at the rear portion of the housing 119 in order to apply a boosted voltage and perform a filter function. An output pipe 125 is installed at the front of the housing 119 so as to access the inside of the waveguide 130 in order to output microwave energy.

Inside the housing 119, a cathode unit 115 having a filament shape is installed in order to radiate a large quantity of heat electrons which are heated by power applied through the filter box 120. An anode unit 111 is also installed therein in order to generate microwave energy by moving the electrons from the cathode unit 115 moving in a requested frequency bandwidth within a vane 113 and a strap 114 according to certain rules when a fixed quantity of anode voltage and anode current are applied to the anode body 112 having the cylinder shape. An antenna 116 is also installed therein in order to transmit the microwave energy generated the operation space of the anode unit 111 and the cathode unit 115 into the waveguide 130. Permanent magnets 117, 118 are respectively installed at the upper portion and the lower portion of the anode body 112 of the anode unit 111 in order to form a vertical magnetic field.

In the magnetron 110, most of energy generated in the space between the anode unit 111 and the cathode unit 115 are converted into microwave energy. However, part of the energy is converted into heat, the converted heat is conducted to the vane 113 and radiated outside of the sealed anode body 112. Accordingly, a cooling apparatus 150 is installed at the circumference of the anode body 112, extending toward the exterior of the casing assembly 100 so as to remove heat which lowers the performance of the magnetron 110.

With reference to FIGS. 5 to 7, the cooling device 150 includes a conduction block 151 associated with the circumference of the anode body 112 from which heat is transmitted a heat pipe 160 installed in the conduction block 151 and extending to the outside of the casing assembly 100 for transferring heat from the conduction block 151 to the outside of the casing assembly through a gas and fluid state transition process and radiation pins 170 installed at the circumference of the heat pipes 160 for radiating and removing heat transmitted through the heat pipe 160.

As depicted in FIGS. 5 and 6, the conduction block 151 is constructed with a block body 152 connected to the heat pipe 160 and adhered to the outer surface of the anode body 112. A block cap 156 is also adhered to the outer surface of the anode body 112 and is connected to the block body 152. The block body 152 and the block cap 156 are assembled with screws 159 and as such are in intimate contact with the outer circumference of the anode body 112.

A groove portion 153 having a U shaped configuration is formed at the center of the block body 152 so as to be inserted into and be complimentary to the outer circumference of the anode body 112. Long holes or channels 154 are formed in the block body 152 for receiving the front end portion 161 of the heat pipes 160.

It is preferable to form a plurality of holes or channels 154 in order to install a plurality of heat pipes 160, and a plurality of screw holes 155 are formed at both side surfaces of the block cap 156 so as to be fastened by a plurality of screws 159.

In the block cap 156, an insertion portion 157 having an arc-shaped contact surface is formed for insertion into the groove portion 153 of the block body 152 and adherence to the outer circumference of the anode body 112. A flange portion 158 is formed at the both sides of the insertion portion 157 for combining with the block body 152 utilizing the screws 159.

The contact surfaces between the anode body 112 and the conduction block 151 are coated with a thermal grease and closely adhered together to perform an effective and efficient heat transfer. Melted lead is injected into the holes or channels 154 of the block body 152 and the heat pipes 160 inserted into the holes 154 are combined by glue having strong heat-resistibility.

As depicted in FIG. 7, the heat pipes 160 transfer heat by using the latent heat of a working fluid. One or a plurality of heat pipes 160 can be installed between the conduction block 151 and the radiation pins 170.

The heat pipe 160 is constructed as a sealed container 165 having a long pipe shape and connected between the conduction block 151 and the radiation pins 170. A wick 167 placed inside the sealed container 165 has a hollow center portion 168 as a transmission passage for fluid and gas and the working fluid is included in the sealed container 165 for transmitting heat through the gas state or fluid state.

As described above, the heat pipe 160 provides a very big heat transfer performance when compared to general heat transfer apparatus using a single phase working fluid. The sealed container 165 is constructed with a metal member having a high degree of heat conductivity such as a cooper, etc. and can have various configurations, such as a cylinder shape or a box shape, etc.

The wick 167 has to have a high transmissivity in order to have a big heat transfer factor without being affected by gravity. It can have a fine screen shape or a grooved shape having a grooved inner wall.

In addition, water of a high degree of purity can be used as the working fluid, and thus the sealed container can be filled with water at a pressure lower than atmospheric pressure.

When the heat generated by the operation of the magnetron 110 works on the front end portion 161 of the heat pipe 160 through the anode body 112 and the conduction block 151, the working fluid inside the sealed container 165 in a lower pressure state is easily evaporated, and thus the pressure rises. Due to the pressure difference the vapor is transferred to the end portion 162 of the heat pipe, namely the sealed container 165 placed at the radiation pin side 170.

The vapor transmitted inside the sealed container 165 at the radiation pin side 170 is condensed by a relatively cold outer temperature and transmitted to the conduction block 151 along the wick 167.

Accordingly, the heat pipe 160 can instantly radiate the heat generated in the magnetron 110 to the outside of the casing assembly 100 by repeatedly performing the above-mentioned process.

As shown in FIG. 5, a hole 106 is formed at the casing assembly 100 through which the heat pipe 160 passes. A sealing member 107 such as a heat-resistant rubber or silicon, etc. is injected between the hole 106 and the heat pipe 160 in order to internally seal the casing.

The radiation pins 170 are constructed of metal plates which are arrayed as a plurality of layers at the exterior of the casing assembly 100 for expanding the heat transfer area. A hole or slot 171 is formed in the radiation pins 170, and the heat pipe 160 is inserted and combined with the hole 171.

As depicted in FIG. 3, in the lighting apparatus using microwave energy in accordance with the first embodiment of the present invention, when the high voltage generator 139 boosts the AC power and supplies the boosted voltage to the magnetron 110, the magnetron 110 generates microwave energy having a very high frequency and outputs it inside the waveguide 130.

The microwave energy output is radiated into the resonator 135 through the waveguide 130, oscillates the enclosed materials inside the bulb 132 and generates a light having an inherent emitting spectrum, and the generated light is emitted to the front through the reflecting mirror 138, 137, where it lightens a space.

As depicted in FIG. 4, the light generated in the microwave generation process of the magnetron 110 transmits its heat to the conduction block 151 through the vane 113 and the anode body 112 consisting of the anode unit 111. The heat is then transferred to the outside of the casing assembly 100 through the heat pip 160 combined to the conduction block 151, and is radiated to the outside through the radiation pins 170.

As described above, in the first embodiment of the present invention, because the heat generated in the magnetron 110 is cooled down through the heat pipe 160 which possesses high heat transfer characteristics, it is possible to reduce the noise which normally occurs when a fan is used to achieve a desired cooling performance. Also, because the casing assembly 100 is sealed, it is possible to eliminate the introduction of impurities such as bugs, etc., into the system, thus providing a reliable lighting apparatus.

In addition, because a fan housing, a cooling fan and a fan motor as used in the background art are not utilized, the installation space required by these elements can be saved, and because the air flow passage is also not required, the structure of the lighting apparatus can be simplified and the total size thereof substantially reduced.

Figure 8:
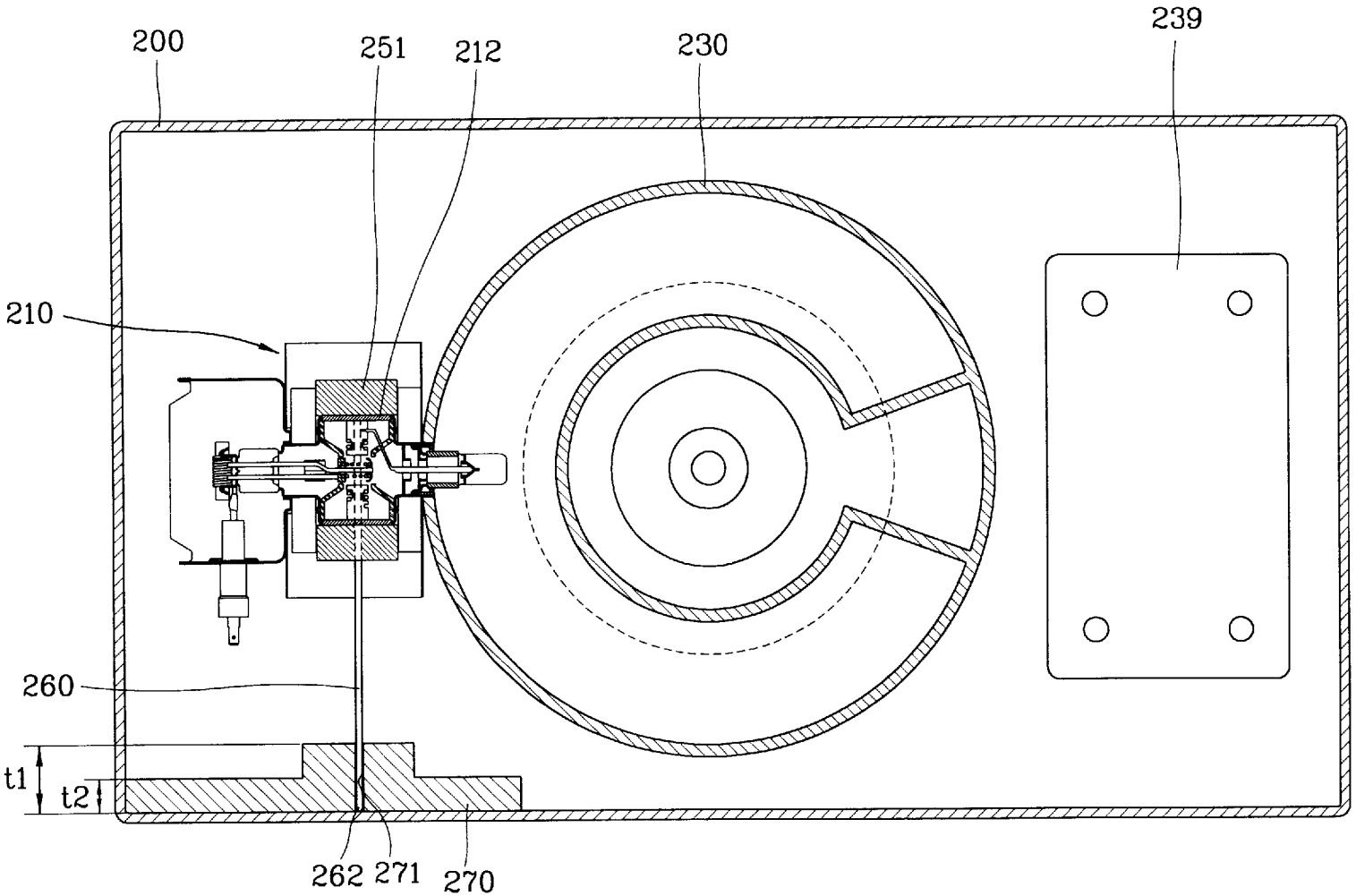
FIG. 8 is a transverse sectional view illustrating a lighting system using microwave energy in accordance with a second embodiment of the present invention.

FIG. 8 is a transverse sectional view illustrating a lighting apparatus using microwave energy in accordance with a second embodiment of the present invention.

Unlike the lighting apparatus in accordance with the first embodiment of the present invention, a lighting apparatus using microwave energy in accordance with a second embodiment of the present invention radiates heat generated in a magnetron 210 by using a casing assembly 200.

The lighting apparatus using microwave energy in accordance with the second embodiment of the present invention includes the magnetron 210 at the side surface of the waveguide 230 and the high voltage generator 239 at the position opposite to that of the magnetron 210.

The conduction block 251 is assembled at the circumference of the anode body 212 of the magnetron 210, and the heat pipe 260 is connected to the conduction block 251 at the interior of the casing assembly 200.

Unlike the lighting apparatus in accordance with the first embodiment of the present invention, a heat transfer block 270 is installed at the end of the heat pipe 260. The heat transfer block 270 is adhered and assembled to the internal wall of the casing assembly 200, so that the heat transmitted through the heat pipe 260 is radiated to the outside through the casing assembly 200.

In the heat transfer block 270, a channel or hole 271 is formed, into which the end portion of the heat pipe 260 is inserted. The thickness ti of the hole formed portion is relatively thicker than the thickness $t_2$ of another portion adhered to the casing assembly 200 for transmitting heat.

The casing assembly 200 is constructed of a metal member having a good heat conductivity. In order to improve the heat transfer efficiency it is preferable to weld/adhere the heat pipe 260 to the heat transfer block 270 and weld/adhere the heat transfer block 270 to the heat pipe 260 with a lead/thermal bond, etc.

In the lighting apparatus using microwave energy in accordance with the second embodiment of the present invention, the heat generated in the magnetron 210 is transmitted to the heat transfer block 270 through the conduction block 251 and the heat pipe 260 and is radiated through the casing assembly 200. Accordingly, the magnetron 210 is cooled. The lighting apparatus using microwave energy in accordance with the second embodiment of the present invention minimizes the presence of noise and prevents contamination with impurities which can cause problems. By not exposing the radiation means as radiation pins at the exterior of the casing assembly but rather constructing it so the heat is radiated through the casing assembly 200, the lighting apparatus in accordance with the second embodiment of the present invention can provide an improved external appearance and permit miniaturization and simplification of the structure of the apparatus.

Figure 9:
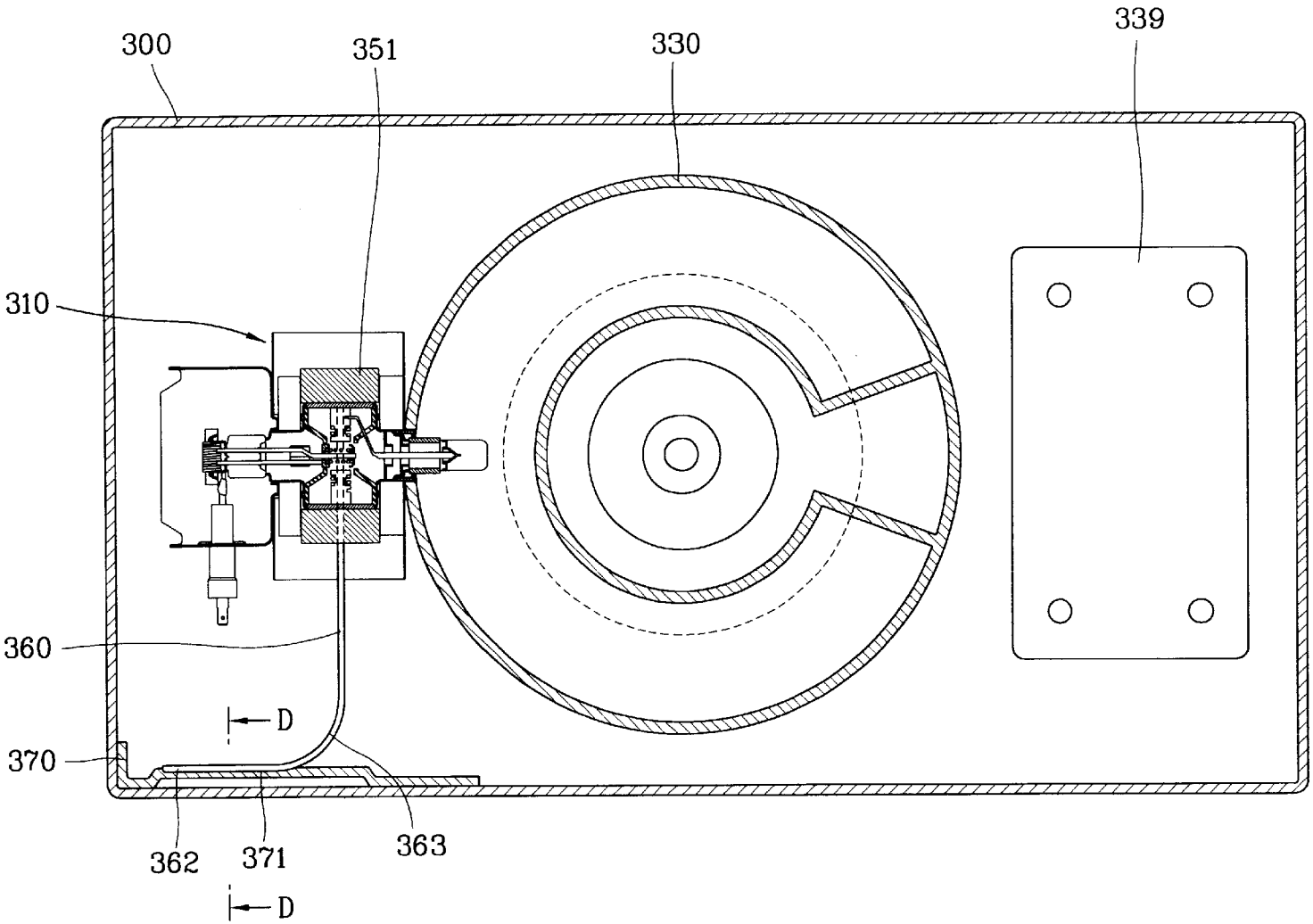
FIG. 9 is a transverse sectional view illustrating a lighting system using microwave energy in accordance with a third embodiment of the present invention.
Figure 10:
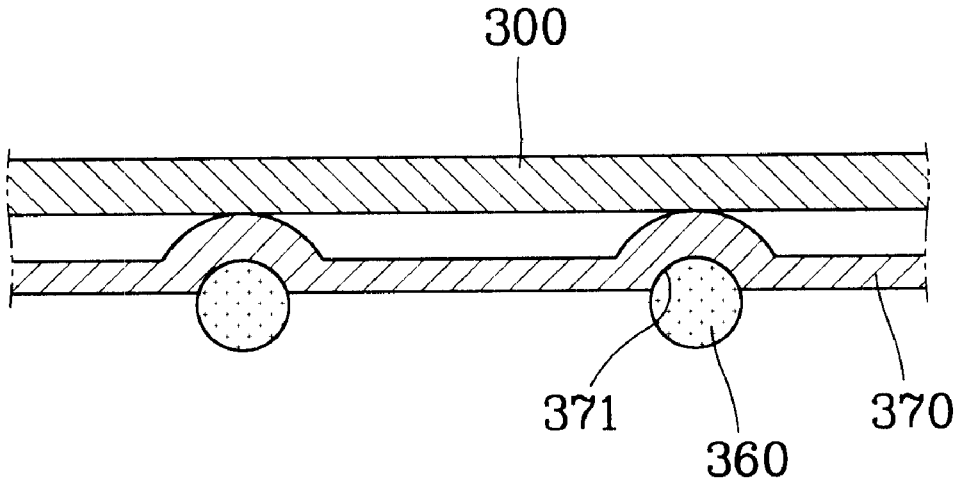
FIG. 10 is a sectional view taken along line D—D of FIG. 9.

FIG. 9 is a transverse sectional view illustrating a lighting apparatus using microwave energy in accordance with a third embodiment of the present invention, FIG. 10 is a sectional view taken along line D—D of FIG. 9. The same elements of the lighting apparatus using microwave energy in accordance with the first embodiment of the present invention are adapted in the third embodiment.

A lighting apparatus using microwave in accordance with a third embodiment of the present invention has a structure using the casing assembly 300 as a radiation plate. The center portion 363 of a heat pipe 360 connecting the conduction block 351 to the interior of the casing assembly 300 is curved, an end portion 362 of the heat pipe 360 is placed so as to be parallel with the interior wall of the casing assembly 300, and a heat transfer bracket 370 is installed between the end portion 362 of the heat pipe 360 and the interior of the casing assembly 300.

The heat transfer bracket 370 is made of a metal plate having a certain thickness and good heat conductivity. A groove portion 371 having the same surface as the external surface of the heat pipe 360 is provided for adherence with the heat pipe 360 to expand the contact area with the heat pipe as depicted in FIG. 10.

In FIG. 9, reference numeral 330 is a waveguide, and reference numeral 339 is a high voltage generator.

In the lighting apparatus using microwave energy in accordance with the third embodiment of the present invention, the heat generated in the magnetron 310 is transmitted to the heat transfer bracket 370 through the conduction block 351 and the heat pipe 360 and is radiated through the casing assembly 300. Accordingly, the magnetron 310 is cooled.

Alternatively, the heat transmitted through the heat pipe 360 can be radiated outside through the casing assembly 300 by removing the heat transfer bracket 370, forming a groove portion at the interior wall of the casing assembly 300 so that the end portion 362 of the heat pipe 360 can directly adhere to the groove portion of the casing assembly 300.

Figure 11:
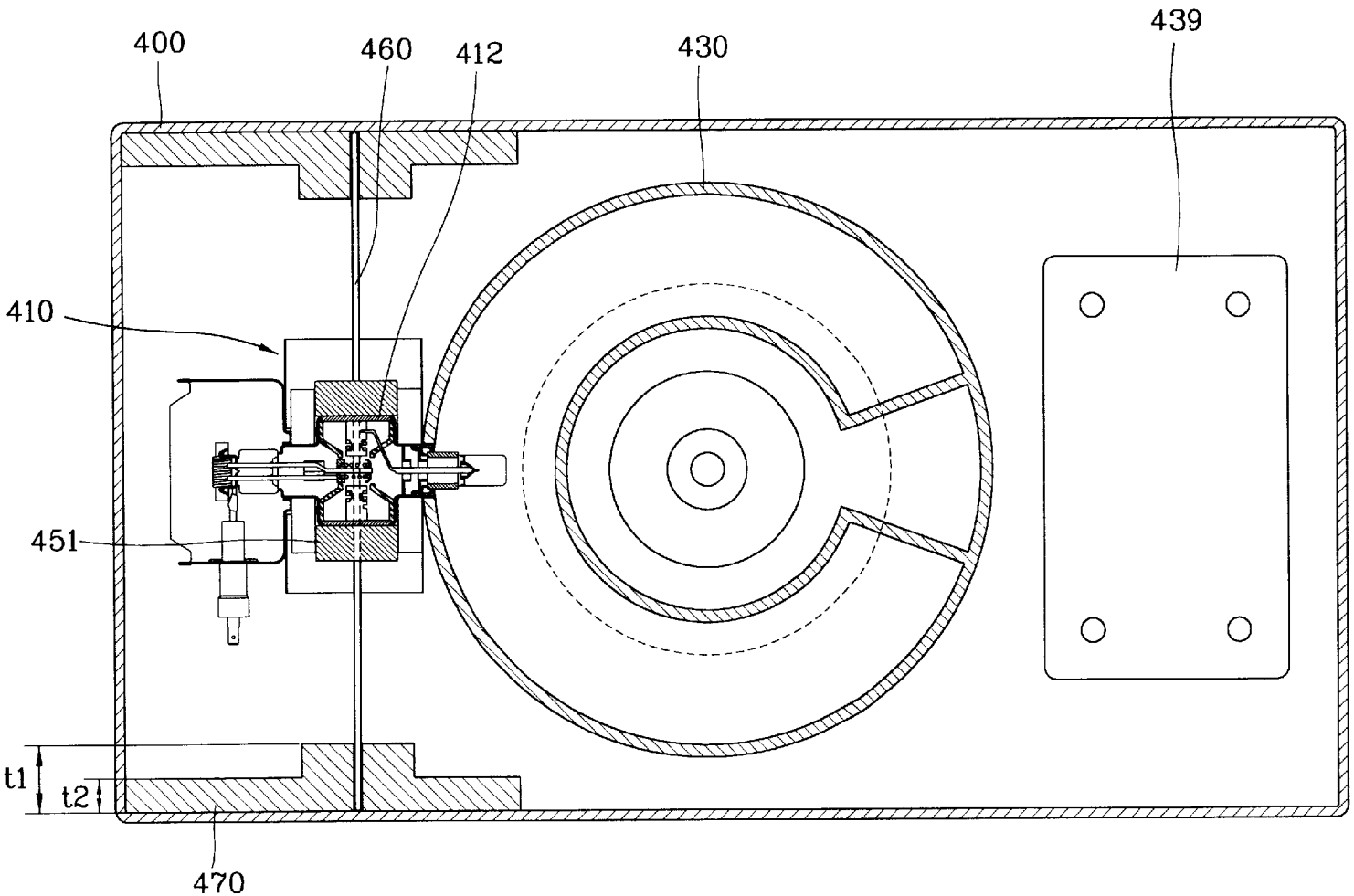
FIG. 11 is a transverse sectional view illustrating a lighting system using microwave energy in accordance with a fourth embodiment of the present invention.

FIG. 11 is a transverse sectional view illustrating a lighting apparatus using microwave in accordance with a fourth embodiment of the present invention.

In the lighting apparatus using microwave energy in accordance with the first, second and third embodiments of the present invention, the heat pipe is used for transmitting heat from a magnetron to internal elements and ultimately to the external casing assembly. However, in the lighting apparatus using microwave energy in accordance with the fourth embodiment of the present invention, heat is transmitted and radiated through a heat conduction rod 460 made of a metal member having a high heat conductivity, instead of the heat pipe.

In more detail, a plurality of heat conduction rods 460 provided connection between a conduction block 451 adhered to the circumference of an anode body 412 of a magnetron 410 inside the casing assembly 400, and a heat conduction block 470 adhered to the interior of the casing assembly 400 and installed at the end of the heat conduction rod 460.

Because the heat conductivity of the heat conduction rod 460 may be lower than the heat conductivity of the heat pipe, it is preferable to use a plurality of heat conduction rods larger than the number of heat pipes, and it is preferable to connect the heat conduction rods 460 through both sides of the magnetron 410 in order to radiate heat generated in the magnetron 410 through the casing assembly 400 as depicted in FIG. 11.

In FIG. 11, reference numeral 430 is a waveguide, and reference numeral 430 is a high voltage generator.

Alternatively, the heat generated in the magnetron 410 can be eliminated by exposing the end portion 462 of the heat conduction rod 460 to the outside of the casing assembly 400, similarly as the first embodiment of the present invention.

Figure 12:
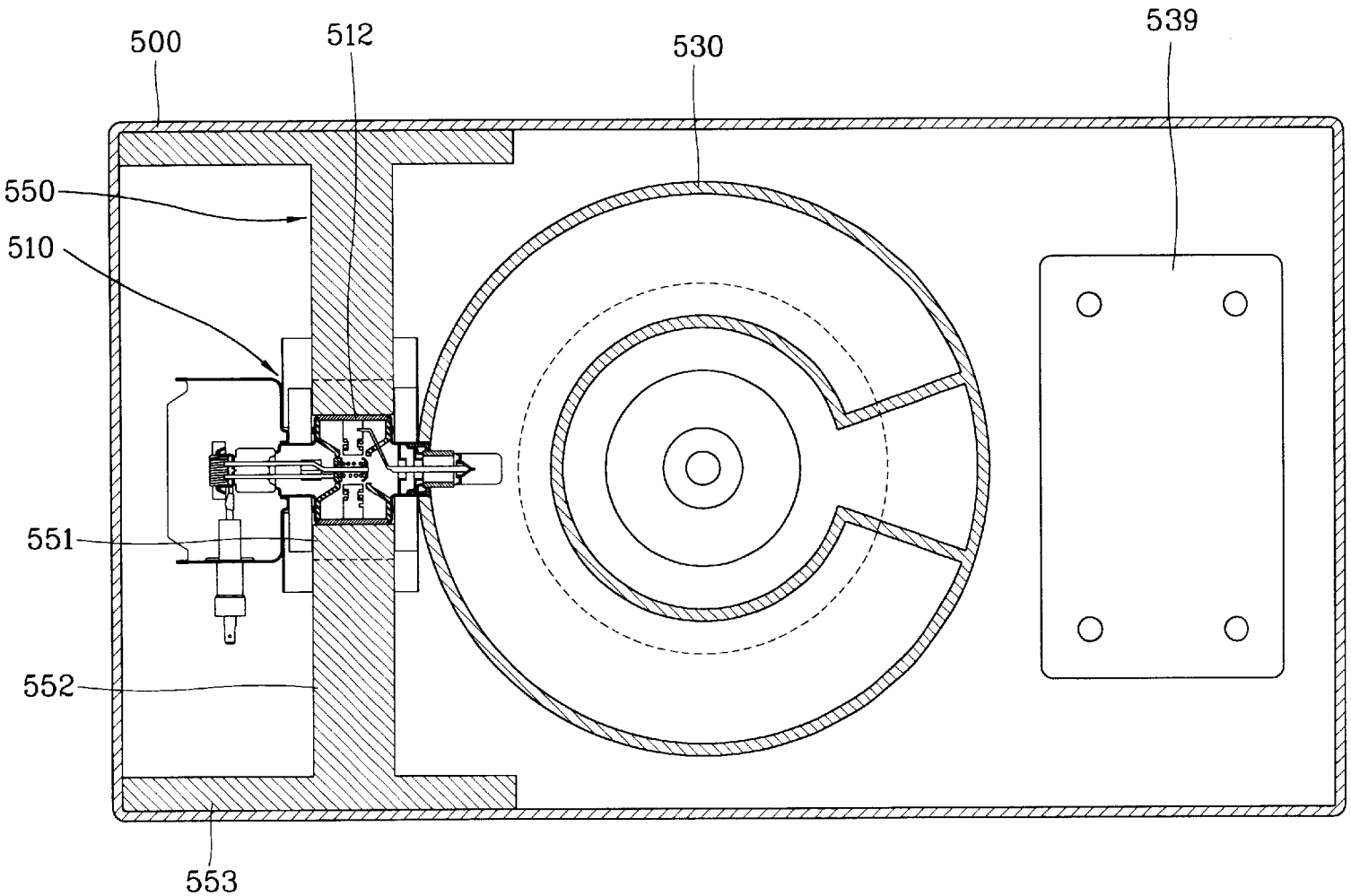
FIG. 12 is a transverse sectional view illustrating a lighting system using microwave energy in accordance with a fifth embodiment of the present invention.

FIG. 12 is a transverse, sectional view illustrating a lighting apparatus using microwave energy in accordance with a fifth embodiment of the present invention.

In the lighting apparatus using microwave energy in accordance with the fifth embodiment of the present invention, a conduction block 550 is extended to the internal surface of the casing assembly 500 for transmitting heat directly to the casing assembly 550.

In more detail, the conduction block 550 is constructed with a cylindrical conduction portion 551 adhered to the circumference of an anode body 512 of a magnetron 510 for transmitting heat created in the generation of microwave energy. A plurality of connection, conduction portions 552 extend from the side of the cylindrical conduction portion 551 to the casing assembly 500 and expanded conduction portions 553 are formed at the end of the connection conduction portions 552 so as to provide bigger contact areas with the internal surface of the casing assembly 500.

It is preferable to form the cylindrical conduction portion 551 the connection conduction portion 552 and the expanded conduction portion 553 of the conduction block 550 as one-body.

In FIG. 12, reference numeral 530 is a waveguide, and reference numeral 539 is a high voltage generator.

Figure 13:
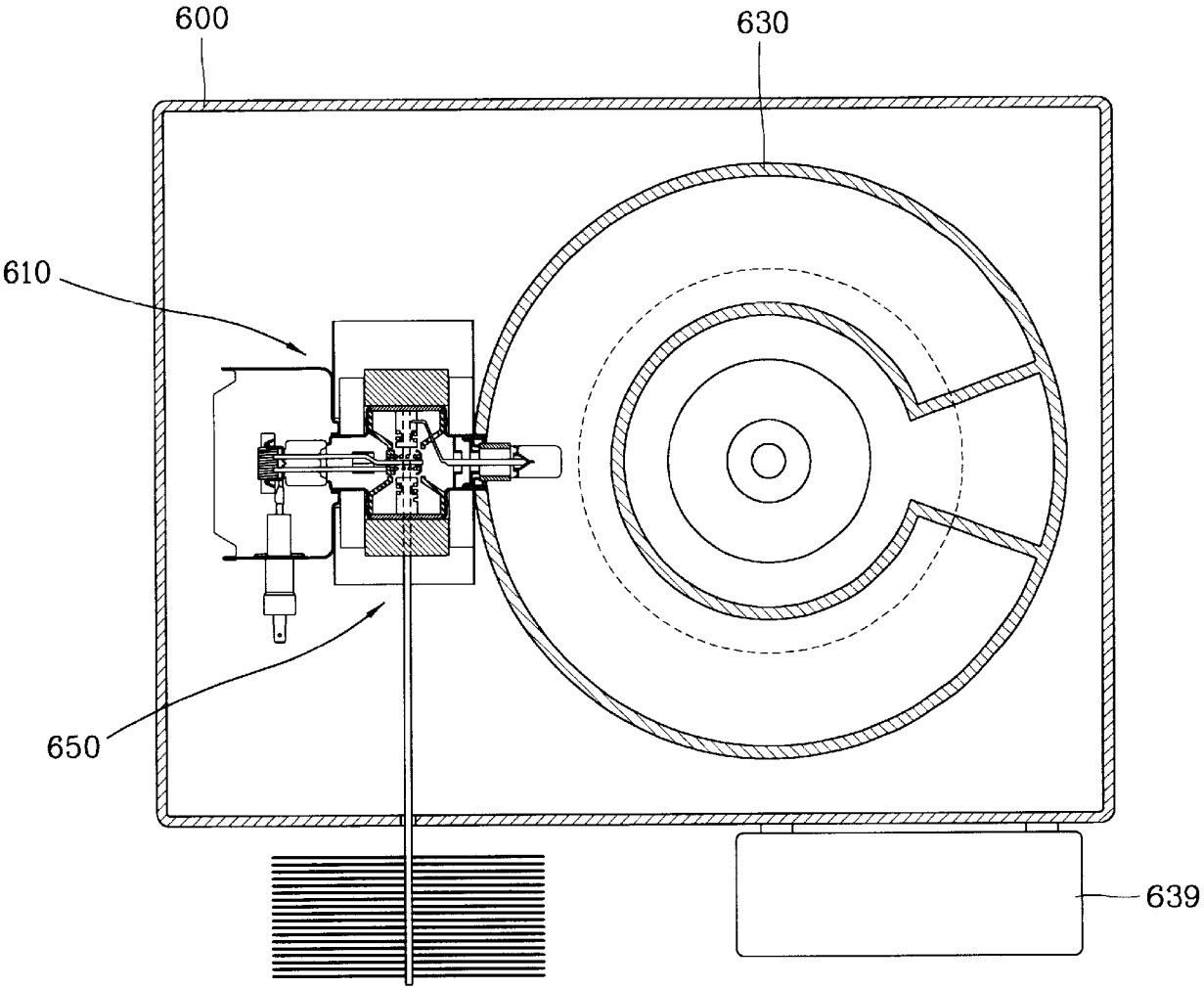
FIG. 13 is a transverse sectional view illustrating a lighting system using microwave energy in accordance with a sixth embodiment of the present invention.

FIG. 13 is a transverse, sectional view illustrating a lighting apparatus using microwave energy in accordance with a sixth embodiment of the present invention.

In accordance with the sixth embodiment of the present invention, a high voltage generator 639 is installed outside of a casing assembly 600.

In more detail, when the high voltage generator 639 boosts the voltage of the utility AC power and applies it to the magnetron 610, heat is generated. In this case, by installing the high voltage generator 639 outside of the casing assembly 600, the temperature rise inside the casing assembly 600 can be reduced.

In FIG. 13, reference numeral 650 is a cooling unit for cooling down the magnetron 610.

Figure 14:
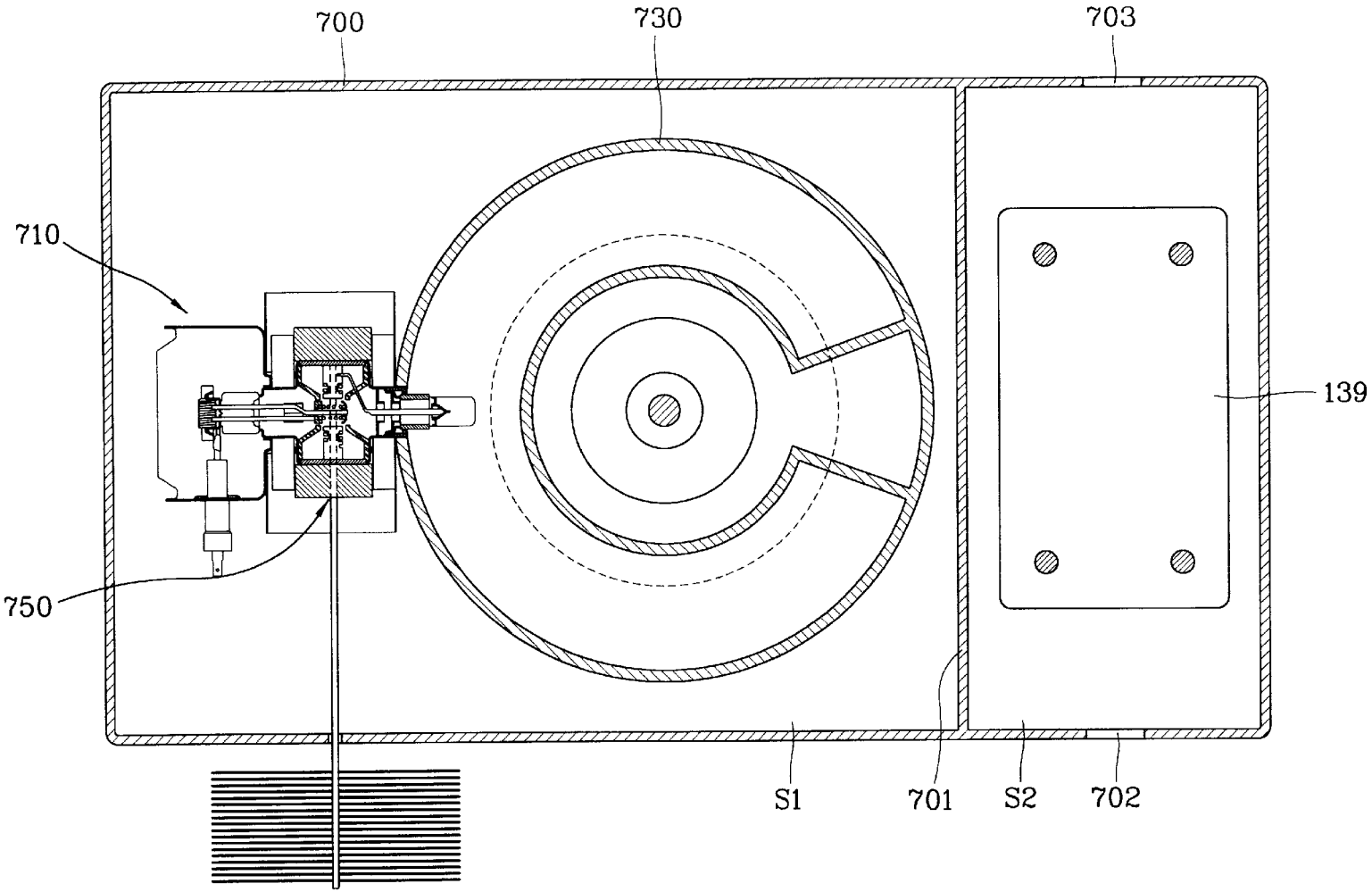
FIG. 14 is a transverse sectional view illustrating a lighting system using microwave energy in accordance with a seventh embodiment of the present invention.

FIG. 14 is a transverse, sectional view illustrating a lighting apparatus using microwave energy in accordance with a seventh embodiment of the present invention. In the lighting apparatus using microwave in accordance with the seventh embodiment of the present invention, by installing a wall 701 inside the casing assembly 700, a space $S_1$ in which the magnetron 710 and the waveguide 730 are installed is separated from a space $S_2$ where the high voltage generator 739 is installed. By forming vents 702, 703 for the space $S_2$, outside air can pass into the space $S_2$ where the high voltage generator 739 is installed. Accordingly, heat generated by the high voltage generator 739 can be cooled by this outside air.

In FIG. 14, reference numeral 750 is a cooling unit for cooling down the magnetron 710.

As described above, because a lighting apparatus using microwave energy in accordance with the present invention can radiate heat generated in a magnetron by utilizing a heat transfer means such as a heat pipe or a heat conduction rod, etc. at the outer or internal surface of the magnetron and the casing, there is no need to use a cooling fan and a cooling motor, etc., and accordingly noise occurrence can be prevented. Thus, the lighting apparatus can be used efficiently in locations requiring quiet lighting circumstances.

In addition, in the lighting apparatus using microwave energy in accordance with the present invention, because the casing is sealed, it is possible to prevent the infiltration of impurities such as bugs, etc. Also, the reliability of the lighting system can be improved by reducing uncleanness and problems created as a result of the presence of impurities.

In addition, in a lighting apparatus using microwave energy in accordance with the present invention, because heat generated in the magnetron is radiated to the outside of the casing through a heat pipe or heat conduction rod, the structure of the lighting system can be simplified and the size of the lighting system can be reduced making it useable in a small space.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A lighting apparatus using microwave energy, comprising:

a casing;

a microwave generator disposed inside the casing for generating microwave energy;

a waveguide for transmitting the microwave energy oscillated by the microwave generator;

a resonator covering an outlet of the waveguide for cutting off the leakage of the microwave energy and passing light;

a bulb disposed inside the resonator for generating light by the microwave energy transmitted through the waveguide;

a conduction block operatively associated with the microwave generator for receiving heat generated during the microwave energy generating process;

radiating means provided by the casing or outside the casing; and heat transfer means providing communication between the conduction block and the radiating means for transmitting heat from the conduction block to the radiating means.

2. The apparatus of claim 1, further comprising a high voltage generator disposed outside of the casing and communicating with the microwave generator, for boosting the voltage of utility AC power and supplying it to the microwave generator.

3. The apparatus of claim 1, further comprising a high voltage generator disposed inside the casing but separated from the space occupied by the microwave generator by a wall, said high voltage generator communicating with said microwave generator in order to boost the voltage of utility AC power and supply it to the microwave generator.

4. A lighting apparatus using microwave, comprising:

a casing;

a microwave generator disposed inside the casing for generating microwave energy;

a waveguide for transmitting the microwave energy oscillated by the microwave generator;

a resonator covering an outlet of the waveguide for cutting off the leakage of the microwave energy and passing light;

a bulb disposed inside the resonator for generating light by the microwave energy transmitted through the waveguide;

a conduction block operatively associated with the microwave generator for receiving heat generated during the microwave energy generating process;

radiating means provided outside the casing; and a heat pipe providing communicating between the conduction block and the radiating means, exterior of the casing, in order to transmit the heat to the radiating means by using the latent heat of a working fluid.

5. The apparatus of claim 4, wherein a hole is formed in the casing for accommodating the heat pipe which passes therethrough, and a sealing member is provided between the hole and the heat pipe to seal the casing.

6. The apparatus of claim 4, wherein the microwave generator is a magnetron which generates microwave energy when power is applied thereto, whereby electrons generated at a cathode unit move in a certain frequency bandwidth within an anode unit having a cylindrically-shaped anode body, and the conduction block is adhered to the anode body so as to receive heat from the anode body generated during the microwave energy generating process.

7. The apparatus of claim 6, wherein thermal grease is coated on contact surfaces of the anode body and the conduction block and they are closely adhered to each other in order to efficiently perform the desired heat transfer.

8. The apparatus of claim 6, wherein the conduction block is constructed of two blocks having a groove portion at each corresponded surface, said blocks being provided at both sides of the anode body.

9. The apparatus of claim 8, wherein the conduction block is constructed of a block body which adheres to one circumferential side of the anode body, and a block cap is adhered to the other circumferential side of the anode body, said block cap being connected to said block body by fastening members.

10. The apparatus of claim 9, wherein the block body has a 'U' shaped configuration which defines a groove for adhering to a circumferential portion of the anode body, and the block cap is formed with an insertion portion fitting into a portion of the groove and also adheres to another circumferential portion of the anode body.

11. The apparatus of claim 10, wherein the block cap has a flange portion at both sides of the insertion portion to facilitate the fastening of the block body by fastening members.

12. The apparatus of claim 9, wherein a long hole is formed in the block body for receiving the heat pipe.

13. A lighting apparatus using microwave, comprising:

a casing;

a microwave generator disposed inside the casing for generating microwave energy;

a waveguide for transmitting the microwave energy oscillated by the microwave generator;

a resonator covering an outlet of the waveguide for cutting off the leakage of the microwave energy and passing light;

a bulb disposed inside the resonator for generating light by the microwave energy transmitted through the waveguide;

a conduction block operatively associated with the microwave generator for receiving heat generated during the microwave energy generating process; and a heat pipe providing communication between the conduction block and the interior wall of the casing in order to transmit heat by using the latent heat of a working fluid, wherein said casing contains a metal member having a high degree of heat conductivity in order to radiate the heat transmitted through the heat pipe to the outside.

14. The apparatus of claim 13, wherein the microwave generator is a magnetron generating microwave energy when power is externally applied while electrons generated in a cathode unit moves in a certain frequency bandwidth within an anode unit having a cylindrically-shaped anode body, and the conduction block is adhered to the anode body for receiving transmitted heat generated during the microwave energy generation process from the anode body.

15. The apparatus of claim 13, wherein a heat transfer member made of a metal plate having a certain thickness is disposed between the end of the heat pipe and the interior of the casing so as to transmit the heat transmitted through the heat pipe to the side of the casing.

16. The apparatus of claim 15, wherein a hole is formed in the heat transfer member so as to receive the end of the heat pipe, and the thickness of the hole-formed portion is relatively thicker than the thickness of the remaining portion of the heat transfer member adhered to the casing for transmitting heat.

17. The apparatus of claim 13, wherein the center portion of the heat pipe is curved, and the end portion of the heat pipe is positioned to be parallel with the interior of the casing.

18. The apparatus of claim 17, wherein the casing has a groove portion formed at its surface which is adhered to the heat pipe and is complimentary to the shape of the exterior of the heat pipe.

19. The apparatus of claim 17, wherein a heat transfer bracket made of a metal plate having a certain width is disposed between the end of the heat pipe and the interior of the casing in order to transmit the heat from the heat pipe to the casing.

20. The apparatus of claim 19, wherein the heat transfer bracket has a groove portion having a shape which is complimentary to the exterior of the heat pipe in order to expand the area of contact with the heat pipe.

21. A lighting apparatus using microwave, comprising:

a casing;

a microwave generator disposed inside the casing for generating microwave energy;

a waveguide for transmitting the microwave energy oscillated by the microwave generator;

a resonator covering an outlet of the waveguide for cutting off the leakage of the microwave energy and passing light;

a bulb disposed inside the resonator for generating light by the microwave energy transmitted through the waveguide;

a conduction block operatively associated with the microwave generator for receiving heat generated during the microwave energy generating process; and a heat conduction rod providing communication between the conduction block and the interior of the casing in order to transmit heat from the conduction block to the interior of the casing;

wherein at least part of said casing is made of a metal member having a high heat conductivity for radiating heat transmitted through the heat pipe to the outside.

22. The apparatus of claim 21, wherein the microwave generator is a magnetron generating microwave energy when power is externally applied while electrons generated in a cathode unit moves in a certain frequency bandwidth within an anode unit having a cylindrically-shaped anode body, and the conduction block is adhered to the anode body for receiving transmitted heat generated during the microwave energy generating process from the anode body.

23. The apparatus of claim 21, wherein a heat transfer member made of a metal plate having a certain thickness is disposed between the end of the heat transfer rod and the interior of the casing in order to transmit the heat transmitted through the heat transfer rod to the casing.

24. The apparatus of claim 23, wherein a hole is formed in the heat transfer member so as to receive the end of the heat transfer rod, and the thickness of the hole-formed portion is relatively thicker than the thickness of the remaining portion of the heat transfer member adhered to the casing for transmitting heat.

25. The apparatus of claim 21, wherein the center portion of the heat transfer rod is curved, and the end portion of the heat transfer rod is positioned to be parallel with the interior of the casing.

26. The apparatus of claim 21, wherein a plurality of the heat transfer rods are connected between the both sides of the microwave generator and the internal surfaces of the casing.

27. A lighting apparatus using microwave, comprising:

a casing;

a microwave generator disposed inside the casing for generating microwave energy;

a waveguide for transmitting the microwave energy oscillated by the microwave generator;

a resonator covering an outlet of the waveguide for cutting off the leakage of the microwave energy and passing light;

a bulb disposed inside the resonator for generating light by the microwave energy transmitted through the waveguide; and a conduction block adhered closely to the microwave generator for receiving the heat generated during the microwave energy generating process and extending to the internal surface of the casing in order to transmit heat to the internal surface of the casing;

wherein at least a part of said casing is made of a metal member having a high heat conductivity so as to radiate the heat transmitted through the conduction block to the outside.

28. The apparatus of claim 27, wherein the conduction block is constructed as one body with a cylindrical conduction portion adhered to the circumference of the microwave generator, at least one extended conduction portion extending from the side of the cylindrical conduction portion to the casing, and an expanded conduction portion provided at the end of the extended conduction portion for providing a larger area in contact with the interior of the casing.

* * * * *